United States Patent [19]

Stein

[11] Patent Number: 5,008,963

[45] Date of Patent: Apr. 23, 1991

[54] EMERGENCY WASH STATION

[75] Inventor: Matthew I. Stein, Truckee, Calif.

[73] Assignee: Haws Company, Sparks, Nev.

[21] Appl. No.: 375,121

[22] Filed: Jul. 3, 1989

[51] Int. Cl.[5] ..... A61H 33/00

[52] U.S. Cl. ..... 4/620; 4/623; 239/16; 239/556; 239/601

[58] Field of Search ..... 4/615, 619, 620, 623, 4/624; 604/294, 298, 300, 302; 138/40, 44; 128/200.14; 239/16, 106, 553, 553.3, 556, 557, 601; 222/420

[56] References Cited

U.S. PATENT DOCUMENTS

| | | | |
|---|---|---|---|
| 442,762 | 12/1890 | Wainwright | 239/106 |
| 2,458,876 | 1/1946 | Rehn | 604/302 |
| 2,482,960 | 9/1949 | Benson | 4/620 |
| 2,874,001 | 2/1959 | Webb | 239/106 |
| 2,910,064 | 10/1959 | Brangaitis | 604/301 |
| 2,999,248 | 9/1961 | Logan et al. | 4/620 |
| 3,170,462 | 1/1962 | Hall | 128/200.23 |
| 3,413,660 | 7/1966 | Lagarelli et al. | 4/620 |
| 3,599,251 | 8/1971 | Wright | 4/620 |
| 3,629,876 | 12/1971 | Wright | 4/620 |
| 3,757,806 | 9/1973 | Shaskar et al. | 134/191 |
| 3,925,829 | 12/1975 | Bost | 4/615 |
| 4,012,798 | 3/1977 | Liautaud | 4/620 |
| 4,363,146 | 12/1982 | Liautaud | 4/620 |
| 4,545,083 | 10/1985 | Searson | 239/556 |
| 4,592,390 | 6/1986 | Boyd | 138/44 |

FOREIGN PATENT DOCUMENTS

| | | | |
|---|---|---|---|
| 661879 | 4/1963 | Canada | 4/620 |
| 1325509 | 3/1963 | France | 4/620 |

OTHER PUBLICATIONS

Speakman Ey and Eye/Face Wash.
Guardian Equipment Eye Washes.
Bradley Corporation Eye Wash Fixture Series 519-210.
Encon Safety Products Yello-Bowl.
Haws Eye Wash Products.

*Primary Examiner*—Henry J. Recla
*Assistant Examiner*—Glenn T. Barrett
*Attorney, Agent, or Firm*—Kelly, Bauersfeld & Lowry

[57] ABSTRACT

An improved emergency wash station is provided for flushing irritants from the eyes or face of an individual, particularly such as a person working in an industrial or laboratory environment. The wash station includes a spray manifold having a large plurality of spray ports disposed above the upper rim of a drain bowl, with the spray manifold being connected to a water supply via a single inlet fitting located externally of the drain bowl. A pressure control member at the inlet fitting insures a relatively gentle yet substantially full face flush spray throughout a range of water supply pressures. In addition, the spray ports are formed with an outwardly expanding taper to minimize clogging by ice or other debris.

18 Claims, 3 Drawing Sheets

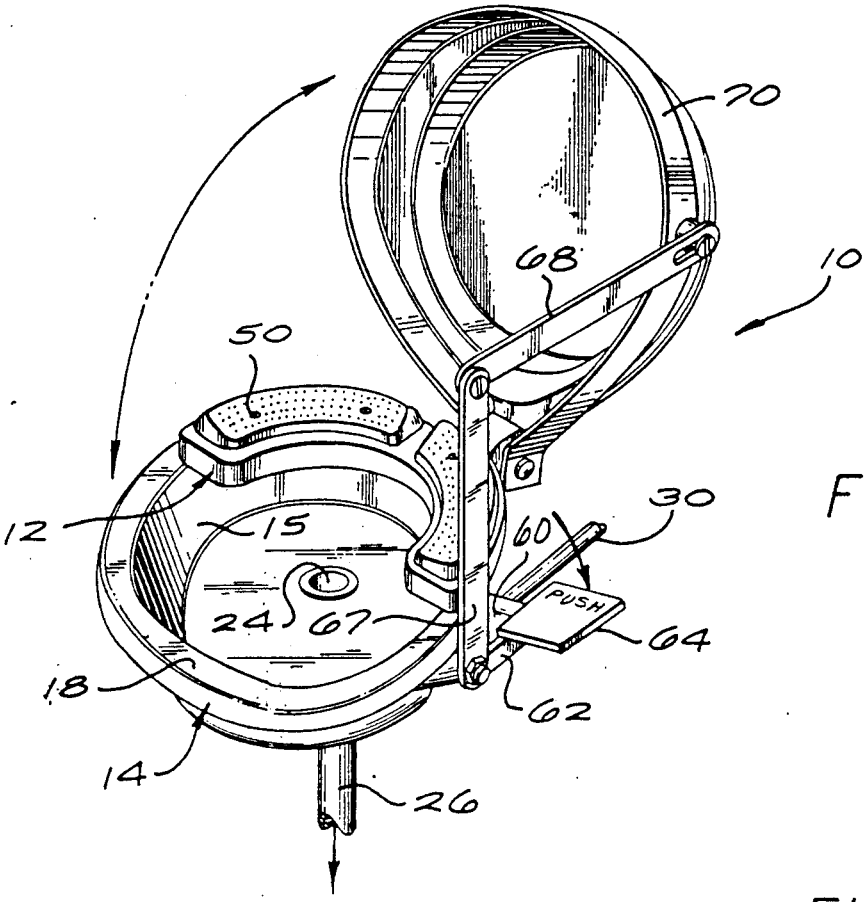
FIG. 1
FIG. 3
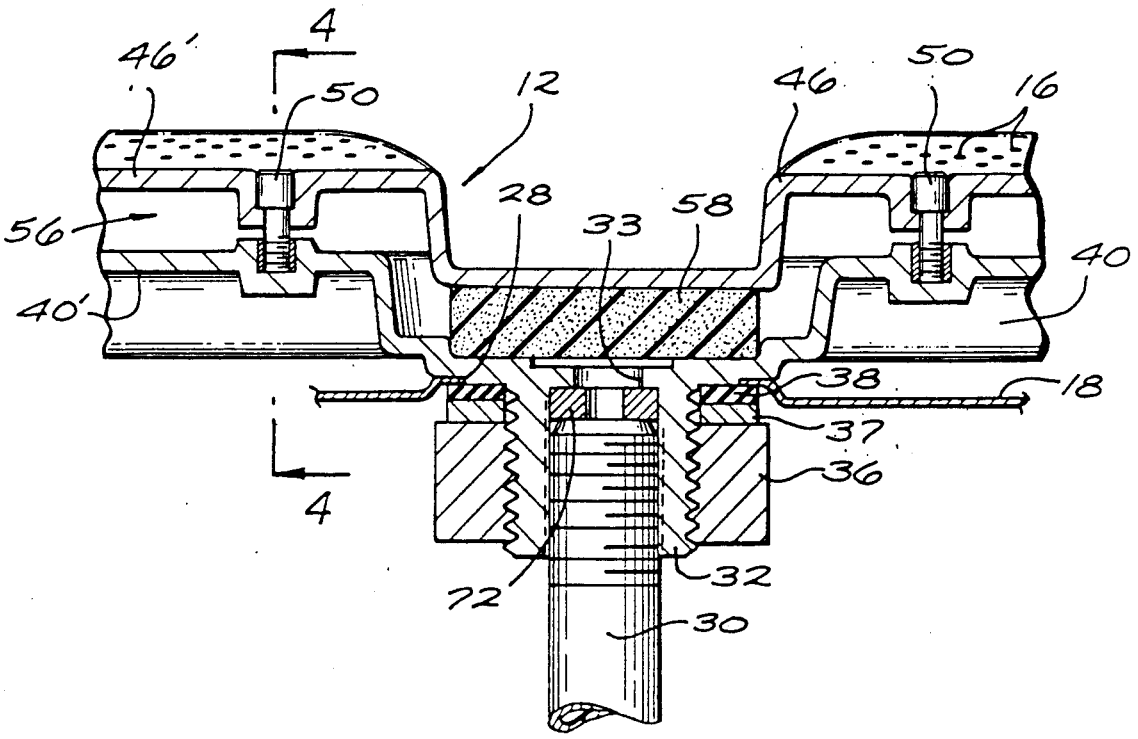

EMERGENCY WASH STATION

BACKGROUND OF THE INVENTION

This invention relates generally to emergency wash equipment for flushing irritants from the eyes and/or face of an individual, particularly such as a person working in an industrial or laboratory environment. More specifically, this invention relates to an improved wash station of relatively simplified construction to provide a gentle yet generous and substantially full face flushing flow of water, wherein water inlet and drain flows are effectively separated to prevent inadvertent mixing during failure mode conditions.

Emergency wash stations are generally known in the art for use in flooding the eyes and/or face of a person with a substantial flushing flow of fresh water. Such stations are commonly used in industrial and/or laboratory environments wherein irritants such as liquid or solid chemicals, fumes, and other toxic substances are present. The wash station typically includes one or more spray nozzles for passage of fresh water to flush irritants which may have contacted the eyes and/or face of a person. An easily operated valve mechanism is normally provided to facilitate water supply connection to the spray nozzles, and a drain basin is normally present to collect and drain the flush water and accumulated contaminants.

In the past, emergency wash stations of the above-described type have generally utilized spray nozzles disposed within or slightly above the drain bowl, and supplied with water via one or more water supply pipes extending into the interior of the drain bowl. See, for example, U.S. Pat. Nos. 3,599,251; 3,629,876; 2,482,960; 2,458,876 and 4,012,798. However, while these wash stations perform satisfactory during normal operation, the positioning of a supply pipe within the drain bowl undesirably permits intermixing of fresh supply water with contaminated drain water during certain failure mode conditions. In particular, in the event of bowl flooding, contaminated waste water within the bowl can backflow into the water supply pipe when certain flow conditions are present, resulting in potential contamination of the fresh water supply. The consequences of such contamination can be significant, depending upon the particular irritant substances which may be present within the flooded drain bowl.

Alternative wash station designs have utilized external plumbing connections supplying water to spray nozzles located typically above opposite sides of an underlying drain bowl. See, for example, U.S. Pat. Nos. 2,999,248 and 3,413,660. However, these networks require relatively complex plumbing arrangements including separate pipe connections to the spray nozzles at opposite sides of the drain bowl. Moreover, the laterally spaced arrangement of the spray nozzles requires nozzle orientation for water discharge at relatively low trajectories in order to achieve substantially full face flush coverage during operation. However, with low spray trajectories, variations in water supply pressure can significantly alter the desired spray pattern, resulting frequently in inadequate face coverage during low pressure conditions or in water overspray during high pressure conditions. Accordingly, such station designs have often included relatively costly pressure control regulator devices to prevent malfunction in response to variable water supply pressures.

The present invention overcomes the problems and disadvantages of the prior art by providing an improved wash station having a spray manifold mounted above and at opposite sides of a drain bowl, and connected by a relatively simple external plumbing fitting to a fresh water supply. The present invention fulfills these needs and provides further related advantages.

SUMMARY OF THE INVENTION

In accordance with the invention, an improved emergency wash station provides a relatively gentle yet substantially full face flushing flow of water to flush irritants from the eyes and/or face of a person. The wash station includes a relatively simple spray means including spray nozzles disposed above and at opposite sides of an underlying drain bowl, wherein the spray means is coupled to a water supply via a single inlet fitting located externally of the drain bowl.

In the preferred form of the invention, the drain bowl is adapted for wall or pedestal mounting and includes a drain outlet for suitable connection to a standard drain pipe. A spray manifold is mounted upon a rearwardly extending upper rim of the drain bowl and defines a relatively large plurality of water spray ports disposed at laterally opposite sides of the bowl at positions spaced substantially above the bowl rim. The spray manifold includes a single inlet fitting adapted for connection through the bowl rim to a water supply pipe. Importantly, the connection between the inlet fitting and the water supply pipe is disposed externally of the drain bowl to prevent intermixing of fresh water with contaminated drain water in the event of bowl flooding combined with back siphonage conditions.

In the preferred form, the spray manifold comprises a pair of interfitting, generally shell-shaped upper and lower manifold members adapted when assembled to define an enlarged manifold pressure chamber extending in both directions from the inlet fitting to both sides of the drain bowl. The spray ports are formed in the upper manifold member for water discharge upwardly to a point generally above the underlying drain bowl. The preferred spray ports have an outwardly expanding taper, such that outward water flow tends to dislodge ice and/or other debris and thereby prevent port clogging.

A relatively simple pressure control member is integrated into the inlet fitting to maintain a substantially constant manifold chamber pressure over a normal range of water supply pressures. The preferred pressure control member comprises a compliant or resilient pressure control disk. A foam filter may also be entrapped at the inlet fitting between the manifold members to filter particulate from the water supply, and further to insure substantially uniform pressure distribution throughout the manifold chamber.

A relatively large and easily operated valve member is normally closed to prevent water supply to the spray manifold. This valve member may be mechanically linked to a dust cover which normally overlies and thus protects the spray manifold and/or drain bowl. In an emergency situation, the valve member is adapted to be shifted easily to an open position, resulting in upward pivoting movement of the dust cover to expose the spray manifold and bowl. Alternately, other types of dust covers such as float-off or pop-off dust covers can be used. Such valve member movement also permits water supply to the spray manifold for upward and gentle spray to flush irritants from the eyes and/or face of a person.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a perspective view illustrating an emergency wash station embodying the novel features of the invention;

FIG. 3 is an enlarged fragmented vertical section taken generally on the line 3—3 of FIG. 2;

DETAILED DESCRIPTION OF THE PREFERRED EMBODIMENT

Figure 2:
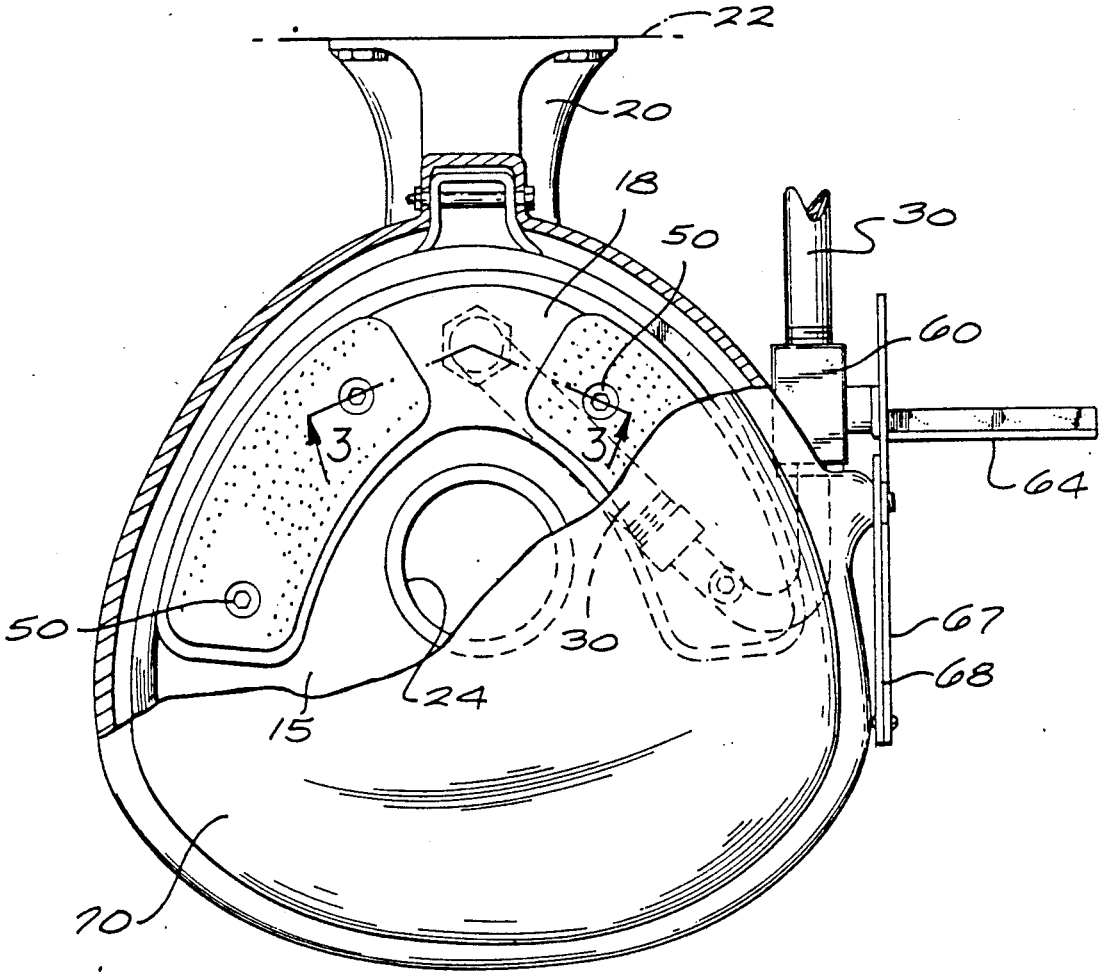
FIG. 2 is an enlarged top plan view of the wash station, with portions broken away to illustrate construction details thereof.

As shown in the exemplary drawings, an improved emergency wash station referred to generally in FIG. 1 by the reference numeral 10 is provided for flushing irritants such as chemicals or other toxic substances from the eyes and/or face of the individual. The wash station 10 includes an elevated spray manifold 12 mounted above the upper rim of a drain bowl 14, wherein the spray manifold is adapted for relatively simple plumbing connection to a water supply pipe (not shown in FIG. 1) at a position located externally of the drain bowl 14. In use, the spray manifold 12 provides a gentle yet substantial flushing flow of fresh water in a substantially full face pattern.

The improved emergency wash station 10 of the present invention incorporates relatively simple spray components and related plumbing connection to provide a highly effective flush flow of fresh water to wash irritants from the ocular region and face of an individual, such as a person working in an industrial or laboratory environment. The spray manifold includes a relatively large plurality of spray ports 16 which are disposed at elevated positions above the upper rim 18 of the underlying drain bowl 14. Such orientation of the spray port 16, in combination with the external connection to the water supply pipe, effectively separates the fresh water supply from drain water which may be contaminated, for example, by the irritants flushed from the individual utilizing the wash station. Accordingly, in the event of bowl flooding for any reason, the contaminated drain water is isolated from the fresh water supply to prevent potential back siphoning or other inadvertent mixture of the water supply.

As shown generally in FIGS, 1 and 2, the drain bowl 14 of the wash station 10 has a generally conventional geometry defining an upwardly open basin 15 adapted to receive and collect water discharged from the spray manifold 12. The drain bowl 14 may be constructed from any convenient material, such as stainless steel, and is adapted for suitable mounting as by connection with a bracket 20 (FIG. 2) to an adjacent wall 22. Alternately, as is known in the art, an appropriate pedestal (not shown) can be provided for supporting the drain bowl 14 at a desired position above a floor. A drain outlet 24 is located in a lower region of the basin and is appropriately connected to a drain pipe 26 for suitable guided passage of flush water to a selected drain site.

As shown best in FIGS. 2 and 3, the upper rim 18 of the drain bowl 14 extends rearwardly from the basin in a generally horizontal plane with sufficient span to accommodate formation of a mounting port 28 through which the water supply pipe 30 is coupled to the spray manifold 12. More specifically, as shown in FIG. 3, the mounting port 28 in the bowl rim 18 is sized to receive a downwardly projecting inlet fitting 32 on the spray manifold 12. This inlet fitting 32, in the preferred form, includes an internally threaded bore for attachment to a threaded end of the water supply pipe 30. In addition, the inlet fitting 32 is externally threaded for mounting of a nut 36 which locks the inlet fitting upon the bowl rim 18 and within the rim mounting port, 28. A stack of fiber and elastomer washers 37 and 38 are desirably interposed between the nut 36 and the underside of the bowl rim 18 to provide a secure and stable compression connection.

The spray manifold 12 is constructed from easily assembled and relatively economical interfitting components which may be formed from lightweight molded plastic or the like. In particular, the illustrative spray manifold 12 includes a lower manifold member 40 having the inlet fitting 32 formed integrally therewith. From the inlet fitting 32, the lower manifold member 40 extends in both directions across the rear of the drain bowl 14 with a generally C-shaped geometry which terminates at the laterally opposite sides of the drain bowl. The peripheral margin of the lower manifold member 40 defines an upwardly open channel or groove 42 adapted to receive an elongated resilient seal member 44, as viewed in FIG. 4. Alternately, the manifold may assume different geometric shapes such as a substantially full circle manifold encircling the underlying bowl, or a simple linear or slightly curved shape extending across the rear of the bowl only. In each case, the spray ports 16 of the spray manifold are oriented to provide collectively a substantially full face flush pattern at a location disposed generally centrally above the underlying bowl.

The spray manifold 12 further includes an upper manifold member 46 having a generally complementary shape adapted to overlie and mount upon the lower manifold member 40. The upper manifold member 46 includes a downwardly projecting peripheral edge 48 which seats against the seal member 44 in the lower channel 42. Connector bolts 50 or the like are fastened through appropriate countersunk seats 52 in the upper manifold member 46 for threaded connection into bosses 54 in the lower manifold member 40, for purposes of securely interconnecting the manifold members with the upper edge 48 in sealing relation with the seal member 44.

When the upper and lower manifold members 46 and 40 are assembled, as described above, the manifold members define upper and lower walls 46, and 40' disposed in vertically spaced, generally parallel relation. Accordingly, these illustrative manifold walls 46' and 40' cooperatively form an enlarged manifold chamber 56 extending in the generally C-shaped geometry throughout the curved length of the assembled spray manifold. Water from the water supply pipe 30 passes through an inlet fitting port 33 into this manifold chamber 56 for subsequent discharge in a substantially full face flush pattern, as will be described. A foam filter 58 or the like is conveniently seated between the manifold walls 46' and 40' (FIG. 3) in the region overlying the inlet port 33 to entrap grit or other particulate.

Figure 5:
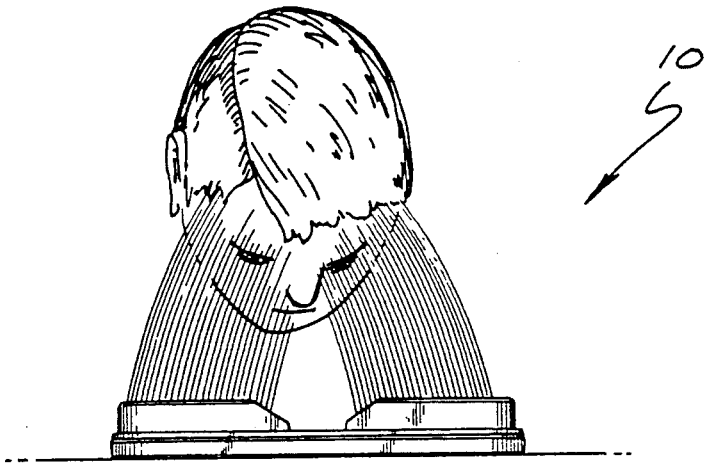
FIG. 5 is a somewhat schematic rear elevation view of the wash station illustrating normal operation thereof.
Figure 6:
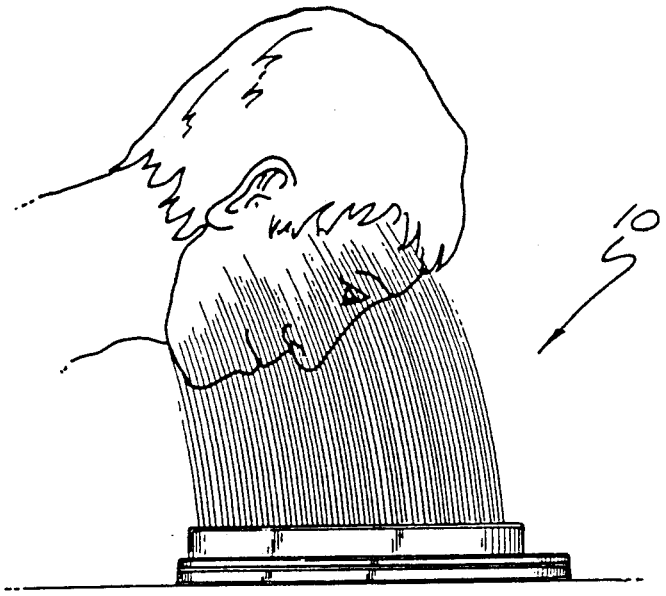
FIG. 6 is a somewhat schematic side elevation view of the wash station.

Substantial portions of the arcuate length of the upper manifold wall 46' are angularly set with a slight tilt toward a vertical axis extending through the drain bowl outlet 24. The large plurality of spray ports 16 are formed in the tilted regions of the manifold wall 46', such that a large plurality of water streams are projected upwardly to a position located generally above the drain bowl 14. Importantly, these spray ports 16 are all located vertically above the bowl rim 18 by a substantial vertical spacing, preferably of at least about one inch. As shown in FIGS. 5 and 6, this large plurality of water streams has a generally C-shaped, substantially full face pattern designed to flood a person's eyes and face in an emergency situation. The spray ports 16 are substantially located within the basin profile and are configured to project the water streams upwardly at a relatively steep angle, such as about 70° or more.

Figure 4:
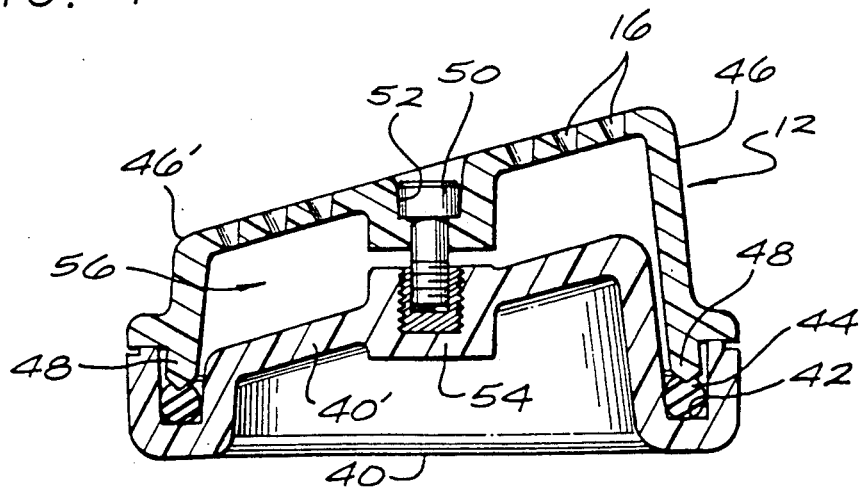
FIG. 4 is an enlarged vertical section taken generally on the line 4—4 of FIG. 3.

In accordance with one aspect of the invention, the spray ports 16 are formed with an outwardly expanding, tapered conical geometry, as shown in FIG. 4. With this configuration, any particulate within the spray ports 12 is normally dislodged by the upwardly projected water streams when water is supplied to the manifold chamber 56. This port geometry is particularly advantageous when the wash station is used in outdoor or other cold temperature conditions, since ice can be formed within the tapered ports as a result of beading within the small ports. Such water beading can freeze during cold weather conditions. However, the outwardly expanding spray ports 16 allow any freezing water to push outwardly within the ports as the water expands upon freezing. Any resultant ice will thus be relatively loose within the ports, and will normally be dislodged by the water flow when the wash station is operated. Accordingly, ice or other particles will not interfere with normal desired station operation.

Water supply to the wash station 10 is controlled by an appropriate valve 60 located in-line with the water supply pipe 30 and mounted at generally one side of the drain bowl 14. This valve 60 includes an internal valve member (not shown) which may be spring biased or pressure biased to a closed position preventing fresh water flow to the spray manifold 12. An actuation lever 62 carries a relatively large push flag 64 for easy location and manipulation to open the valve 60 for water flow to the spray manifold. In one preferred form, the actuation lever 62 may also be connected via crank links 67 and 68 to a dust cover 70 which is pivotally mounted onto the rear of the bowl 19 to overlie the bowl and spray manifold when the valve 60 is closed. Alternately, a foot-operated valve mechanism may be used, if desired. Still further, other types of dust covers such as floating or pop-up dust covers can be used as desired to overlie and protect the manifold and/or the bowl.

In an emergency situation, in spite of irritants which may be present in a person's eyes or facial area, the push flag 64 is easily located and depressed rearwardly (FIG. 1) to lift the dust cover 70 and open the valve 60. Fresh water flows through the inlet fitting 32 to the spray manifold 12 for upward projection as a large plurality of relatively gentle water streams (FIGS. 5 and 6). These water streams are effective to bathe and flush irritants and or other toxic substances from the person's face. The profile of the stream spray pattern is advantageously maintained substantially constant in spite of normal variations in water supply pressure by incorporating a resilient flow control washer 72 at the manifold inlet port 33 (FIG. 3). This flow control washer 72 effectively maintains the water pressure within the manifold chamber 56 substantially constant over a normal range of water supply pressures, thereby assuring substantially uniform flush flow spray pattern.

The improved wash station 10 of the present invention thus provides an effective flush flow pattern projected from spray ports which are located substantially above the rim 18 of the drain bowl 14, and further which are connected to a water supply via plumbing connections disposed externally of the drain bowl. The projected water streams are provided at a steep angle to yield a gentle flow within a vertical envelope of the basin 15. Moreover, the spray manifold includes spray ports of expanding geometry to prevent significant blockage of the ports as a result of ice or other debris. A single water supply connection communicates fresh water to all of the spray ports 16, with the water supply pressure being maintained substantially constant during normal operating conditions by use of the compliant flow control washer 72.

A variety of further modifications and improvements to the wash station 10 of the present invention will be apparent to those skilled in the art. For example, the curved geometry of the spray manifold can be varied as desired in accordance with the desired spray pattern and/or configuration of the underlying drain bowl. Further, in some installations, it may be desirable to utilize the spray manifold as an emergency wash unit without an underlying drain bowl. Accordingly, no limitation on the invention are intended by way of the foregoing description and accompanying drawings, except as set forth in the appended claims.

What is claimed is:

1. An a emergency wash station, comprising:

a drain bowl having an upper rim extending outwardly from a basin;

a spray manifold mounted onto said upper rim of said drain bowl, said spray manifold including upper and lower interfitting and generally shell-shaped manifold members cooperatively defining a manifold chamber, said spray manifold further including a single water inlet fitting for connection of said manifold chamber to a water supply, said inlet fitting being received through a mounting port formed in said upper rim generally at a rear side of said drain bowl, and a plurality of generally upwardly open spray ports formed in said upper manifold member for passage of water from said manifold chamber in a generally upward direction as a plurality of relatively gentle water streams, each of said spray ports being disposed elevationally at a substantial distance above said upper rim of said drain bowl; and means for connecting a water supply pipe to the inlet fitting and for securing said inlet fitting in position relative to said upper rim, said connecting means being disposed externally of said drain bowl;

said spray manifold having a curved, generally C-shaped geometry with said inlet fitting disposed generally centrally with respect thereto, said spray manifold and said manifold chamber extending from said inlet fitting in opposite directions to laterally opposite sides of the drain bowl.

2. The wash station of claim 1, wherein each of said spray ports is disposed above said upper rim by a distance of at least one inch.

3. The wash station of claim 1 further including a pressure regulator member at said inlet fitting for regulating the pressure of water within said manifold chamber.

4. The wash station of claim 3 wherein said pressure regulator member comprises a resilient flow control washer.

5. The wash station of claim 1 further including filter means disposed generally at said inlet fitting.

6. The wash station of claim 1 wherein said spray ports are oriented to project water streams in a generally upward direction over said bowl with an angle of inclination of at least about 70°.

7. The wash station of claim 1 wherein said spray ports are formed with an outwardly expanding tapered geometry.

8. The wash station of claim 1 wherein said connecting means further includes a water supply pipe for connection to said inlet fitting, a normally closed valve mounted in-line with said water supply pipe, and means for opening said valve to supply water to said manifold chamber.

9. The wash station of claim 1 wherein inlet fitting is formed integrally with said lower manifold member.

10. An emergency wash station, comprising:

a drain bowl having an upper rim projecting outwardly from a basin, said upper rim having a mounting port formed therein at a position located generally at a rear side of the drain bowl;

a spray manifold having a curved, generally C-shaped geometry and including upper and lower interfitting and generally shell-shaped manifold members cooperatively defining a manifold chamber extending generally in opposite directions from an inlet fitting adapted for passage of water into the manifold chamber, said upper manifold member of said spray manifold further defining a relatively large plurality of generally upwardly open spray ports for passage of water upwardly from said manifold chamber as a plurality of small water streams;

means for mounting said inlet fitting to said upper rim with said inlet fitting projecting through said mounting port and with said spray ports of said spray manifold each located a substantial distance above said upper rim, said spray manifold extending from said inlet fitting to laterally opposite sides of the drain bowl;

means for connecting a water supply pipe to said inlet fitting; and valve means mounted in-line with said water supply pipe and normally closed to prevent water flow to said manifold chamber, said valve means being movable to an open position to permit water flow to said manifold chamber.

11. The wash station of claim 10 further including a resilient flow control washer within said inlet fitting.

12. The wash station of claim 10 further including filter means disposed generally at said inlet fitting.

13. The wash station of claim 10 wherein said spray ports are oriented to project water streams in a generally upward direction over said bowl with an angle of inclination of at least about 70°.

14. The wash station of claim 10 wherein said spray ports are formed with an outwardly expanding tapered geometry.

15. The wash station of claim 10 wherein said inlet fitting is formed integrally with said lower manifold member.

16. The wash station of claim 10 further including dust cover means removably received over said spray manifold.

17. An emergency wash station, comprising:

a spray manifold including upper and lower interfitting and generally shell-shaped manifold members cooperatively defining an enlarged and substantially open manifold chamber for connection to a water supply, and a plurality of generally upwardly open spray ports framed in said upper manifold member for passage of water from said manifold chamber as a plurality of relatively gentle water streams, each of said spray ports having an outwardly expanding tapered geometry with the upstream end of each of said spray ports communicating directly with said manifold chamber; and inlet means for passage of a supply of water under pressure into said manifold chamber.

18. An emergency wash station, comprising:

a spray manifold having a curved, generally C-shaped geometry defined by upper and lower, generally C-shaped and shell-shaped interfitting manifold members cooperatively defining a manifold chamber, and a plurality of generally upwardly open spray ports formed in said upper manifold member for passage of water from said manifold chamber as a plurality of relatively gentle water streams; and inlet means for passage of a supply of water into said manifold chamber.

* * * * *